US010799874B2

(12) United States Patent
Indraganti et al.

(10) Patent No.: US 10,799,874 B2
(45) Date of Patent: Oct. 13, 2020

(54) MODIFIED JOURNAL ASSEMBLY FOR PULVERIZER

(71) Applicant: General Electric Technology GmbH, Baden (CH)

(72) Inventors: Satya Sai Ramchandra Rao Indraganti, Karnataka (IN); Krishnendu Aditya, Kolkata (IN); Sunil Chauhan, Ghaziabad (IN); Mahesh Govind Kendhe, Delhi (IN)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 576 days.

(21) Appl. No.: 15/160,701

(22) Filed: May 20, 2016

(65) Prior Publication Data

US 2016/0346787 A1 Dec. 1, 2016

(30) Foreign Application Priority Data

May 27, 2015 (IN) ..... 1516/DEL/2015

(51) Int. Cl.
*B02C 15/04* (2006.01)
*B02C 15/00* (2006.01)

(52) U.S. Cl.
CPC ..... *B02C 15/04* (2013.01); *B02C 15/004* (2013.01); *B02C 15/045* (2013.01)

(58) Field of Classification Search
CPC ..... B02C 15/04; B02C 15/004; B02C 15/045
USPC ..... 241/121, 129, 131
See application file for complete search history.

(56) References Cited

U.S. PATENT DOCUMENTS 4,127,237 A * 11/1978 Mehta ..... B02C 15/04 241/117
4,432,500 A * 2/1984 Brundiek ..... B02C 15/04 241/121
4,538,768 A * 9/1985 Paskowski, Jr. ..... B02C 15/004 241/101.2
5,067,662 A * 11/1991 Chang ..... B02C 15/045 241/119
5,244,157 A * 9/1993 Brundiek ..... B02C 15/04 241/119
5,538,192 A * 7/1996 Parham ..... B02C 15/04 241/121
5,597,124 A * 1/1997 Kessel ..... B02C 15/04 241/121
7,226,010 B2 * 6/2007 Zhang ..... B02C 15/00 241/117
8,491,196 B2 * 7/2013 Creelman ..... B02C 15/004 384/571

(Continued)

*Primary Examiner* — Faye Francis
*Assistant Examiner* — Smith Oberto Bapthelus
(74) *Attorney, Agent, or Firm* — Grogan, Tuccillo & Vanderleeden, LLP

(57) ABSTRACT

The present disclosure relates to a pulverizer includes a pulverizer housing with an grinding assembly having a grinding table situated therein. The grinding table provides a grinding surface area for a material, such as a fossil fuel, such as coal, to be pulverized. The grinding table is mounted on a gearbox shaft operatively connected to a gearbox drive mechanism so as to be capable of driven rotation within the pulverizer housing. A journal assembly having a journal head and the journal assembly and a spring assembly are mounted on the pulverizer housing so that the journal head engage the spring assembly.

7 Claims, 3 Drawing Sheets

(56) References Cited

U.S. PATENT DOCUMENTS

| | | | | |
|---|---|---|---|---|
| 8,602,338 | B2 * | 12/2013 | Stone | B02C 15/04 241/121 |
| 8,608,097 | B2 * | 12/2013 | Murphy | B02C 25/00 241/33 |
| 2006/0255195 | A1 * | 11/2006 | Chen | B02C 15/001 241/79.1 |
| 2006/0273209 | A1 * | 12/2006 | Parham | B02C 15/04 241/121 |
| 2008/0237379 | A1 * | 10/2008 | Briggs | B02C 15/04 241/121 |
| 2009/0308961 | A1 * | 12/2009 | Nelson | B02C 15/04 241/121 |
| 2009/0314866 | A1 * | 12/2009 | Hoffmann | B02C 15/04 241/120 |
| 2010/0012760 | A1 * | 1/2010 | Guerrero Palma | B02C 15/04 241/230 |
| 2010/0119187 | A1 * | 5/2010 | Creelman | B02C 15/004 384/571 |
| 2011/0133009 | A1 * | 6/2011 | Wark | B02C 15/04 241/285.1 |
| 2014/0197260 | A1 * | 7/2014 | Futahashi | B02C 15/04 241/117 |
| 2014/0263786 | A1 * | 9/2014 | Tamura | B02C 25/00 241/121 |
| 2016/0346787 | A1 * | 12/2016 | Rao | B02C 15/04 |

* cited by examiner

MODIFIED JOURNAL ASSEMBLY FOR PULVERIZER

FIELD OF THE INVENTION

The present invention relates to fuel pulverizers, and more specifically, to a modified journal assembly for pulverizer.

BACKGROUND OF THE INVENTION

Solid fossil fuels such as coal often are ground in order to render the solid fossil fuel suitable for certain applications. Grinding the solid fossil fuel can be accomplished using a device referred to by those skilled in the art as a pulverizer. One type of coal pulverizer suited for grinding is referred to as a "bowl mill pulverizer". This type of pulverizer obtains its name by virtue of the fact that the pulverization that takes place therein is effected on a grinding surface that in configuration bears a resemblance to a bowl.

Present Bowl mill pulverizers operating now days facing short short life of journal assembly due to deficiency in design of the Bowl mill pulverizers. Power plants face sudden non availability of the Bowl mill pulverizers due to this problem. In present Bowl mill there are multiple type of housing assembly and multiple type of bearing in the journal assembly. Due to different type of bearings and housings makes the journal assembly process quite complex like two end plays are required to ensure correct functioning of bearings and as numerous housings are required to accommodate various bearings, the fitment process become complex and creates a provision for entry of foreign materials/dust. Personal skill in the art find it very difficult to assemble/dissemble the equipment due to complexity of housings and fitments of bearings are very problematic for fitment. Further in present Bowl mill pulverizers causes rough operation. Rough operation causes high bending stresses to be placed on a journal shaft of the pulverizer, which can result in its failure. These stresses are also high enough that many component failures have been attributed to such rough operation. A End Play of the journal shaft is the vertical movement of the journal shaft relative to a journal housing. This indicates the initial movement of the journal shaft in bearing fitted condition. Over the time after prolonged service, this end play increases due to wear & tear. With end play values beyond limit, the mill performance get affected with lower & uneven clearance of a grinding roll and a bull ring segment. So, end play limits are crucial for mill performance.

It is important that any solution to these existing pulverizer is capable of implementation within existing journal assembly due to the expense of otherwise replacing such equipment. Accordingly, any solution must be able to be used with or "retrofitted" to fit within existing journal assembly of a shallow bowl mill.

SUMMARY OF THE INVENTION

The present invention is a pulverizer with a journal assembly for shallow bowl mills used in fossil fuel pulverization. The subject pulerizer with the journal assembly is used with or the journal assembly can be "retrofit" within existing journal space a shallow bowl mill.

Accordingly, the present disclosure provides a pulverizer comprising a grinding assembly including a grinding table which provides a grinding surface to pulverize fuel, at least one journal assembly including a journal head connected to a journal shaft to support at least one grinding roll, the journal shaft transmits a force through the at least grinding roll which rotates on the grinding surface due to rotational force provided by the grinding table to pulverize the fuel, the at least one journal assembly is pivotally mounted on a pair of pivot shaft to move pivotally in a pivoting motion towards the grinding surface, at least one spring assembly including a spring in a spring housing which provides support and the force for the pulverization of the fuel to the journal assembly through the journal head.

In another embodiment the pair of pivot shaft connect the at least one journal assembly to pulverizer housing.

In yet another embodiment at least one single type of bearing provides rigidity and support to the rotation of the at least one grinding roll in the at least one journal assembly.

In yet another embodiment a single housing is provided to accommodate all the bearings in the at least one journal assembly.

In yet another embodiment the single housing is made from casting or forging in the at least one journal assembly.

In yet another embodiment one end play is required for all the bearings in the at least one journal assembly.

In yet another embodiment the at least one journal assembly is sized for retrofit in the pulverizer housing.

The present invention offers a technical solution for all the above mentioned problems by providing same type of bearings in the journal assembly which leads to the requirement of one end play. A further aspect of the present disclosure includes a one housing which is enough to accommodate all the bearings in place which eases the assembly and dismantling and prevents the entry of foreign particles and dust. The single housing having all the bearings in it operates as single unit. The two pivot shaft handle the uneven stress better at free end and thrust end. Further the double pivot shaft provides better air circulation. Various other objects and features of the present disclosure will be apparent from the following detailed description and claims.

These together with the other aspects of the present disclosure, along with the various features of novelty that characterize the present disclosure, are pointed out with particularity in the present disclosure. For a better understanding of the present disclosure, its operating advantages, and its uses, reference should be made to the accompanying drawings and descriptive matter in which there are illustrated exemplary embodiments of the present disclosure.

BRIEF DESCRIPTION OF THE DRAWINGS

The advantages and features of the present disclosure will be better understood with reference to the following detailed description and claims taken in conjunction with the accompanying drawings, wherein like elements are identified with like symbols, and in which:

DETAILED DESCRIPTION OF THE PRESENT DISCLOSURE

Figure 1:
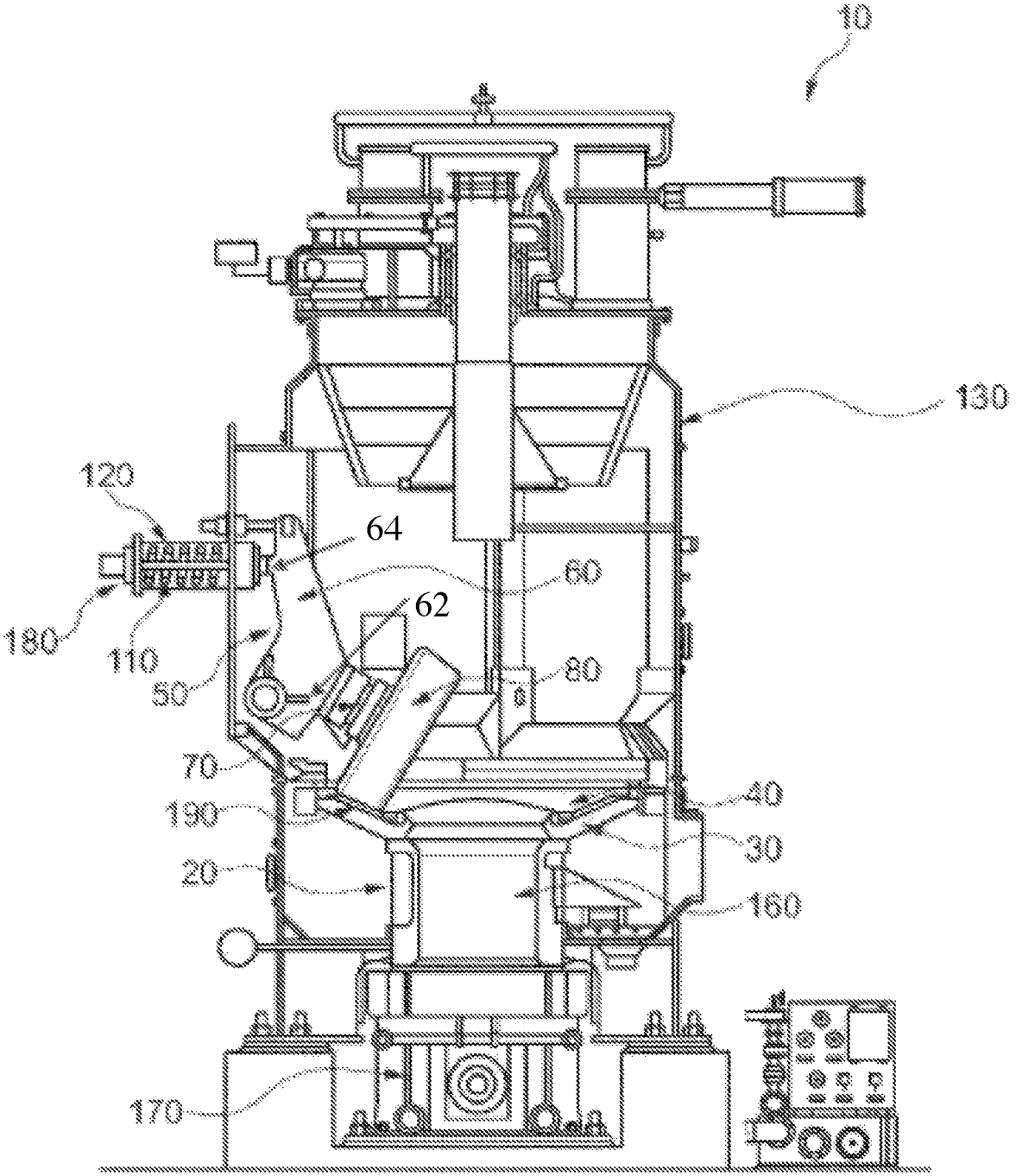
FIG. 1 is a front view of a pulverizer, in accordance with an exemplary embodiment of the present disclosure.
Figure 2:
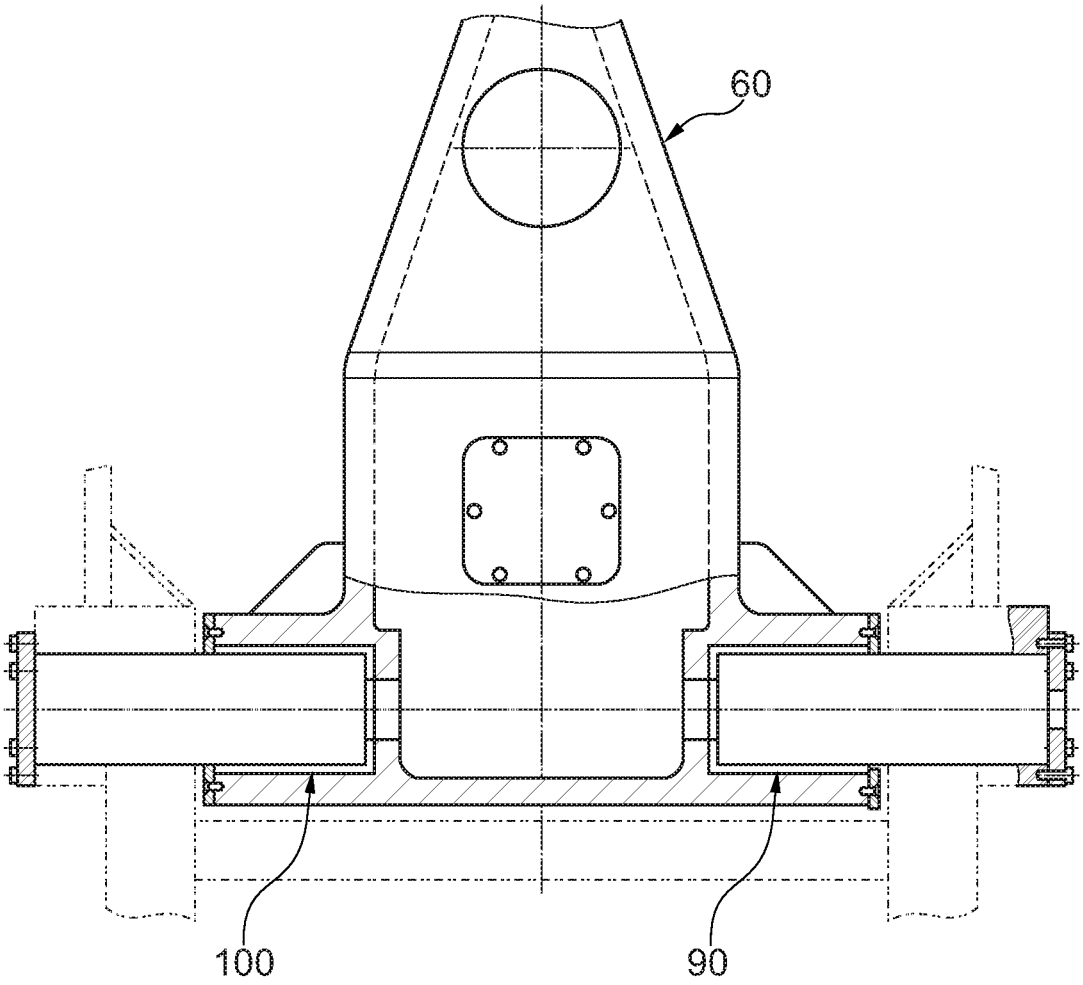
FIG. 2 is a section view of a journal shaft assembly with a pair of pivot shaft in accordance with an exemplary embodiment of the present disclosure.

Referring now to FIG. 1, A pulverizer 10 for example a shallow bowl mill-type that includes a pulverizer housing 130 with an grinding assembly 20 having a grinding table 30 situated therein. The grinding table 30 provides a grinding surface Bull Ring Segment for a material, such as a fossil fuel, such as coal, to be pulverized. The grinding table 30 is mounted on a gearbox shaft 160 operatively connected to a gearbox drive mechanism 170 so as to be capable of driven rotation within the pulverizer housing 130. A journal assembly 50 having a journal head 60 and the journal assembly 50 and a spring assembly 180 are mounted on the pulverizer housing 130 so that the journal head 60 engage the spring assembly 180. The spring assembly 180 includes a spring 110 in a spring housing 120 provides support and a force for example a spring force for pulverization of the fuel.

Referring now to FIG. 1, A pulverizer 10 for example a shallow bowl mill-type that includes a pulverizer housing 130 with an grinding assembly 20 having a grinding table 30 situated therein. The grinding table 30 provides a grinding surface Bull Ring Segment for a material, such as a fossil fuel, such as coal, to be pulverized. The grinding table 30 is mounted on a gearbox shaft 160 operatively connected to a gearbox drive mechanism 170 so as to be capable of driven rotation within the pulverizer housing 130. A journal assembly 50 having a journal head 60 with a first end 62 and a second end 64 and the journal assembly 50 and a spring assembly 180 are mounted on the pulverizer housing 130 so that the journal head 60 engage the spring assembly 180. The spring assembly 180 includes a spring 110 in a spring housing 120 provides support and a force for example a spring force for pulverization of the fuel.

The journal assembly 50 pivots away from the grinding surface area 40 e.g., in response to the introduction of the fuel in form of granule material between the grinding surface area 40 and the grinding roll 80 the journal head 60 engages the spring assembly 180 imposes the spring force upon the journal head 60 at the second end 64. The journal assembly 50 then conveys the spring force onto the fuel to be pulverized via the grinding roll 80. The more that the fuel in the form of granule material causes the journal assembly 50 to pivot away from the grinding surface area 40, the more the spring assembly 180 are compressed and the greater the spring force that is imposed on the journal head 60.

The journal head 60 transmit this force to a journal shaft 70 which is connected to it at the first end of the journal head 60. The journal shaft 70 supports the grinding roll 80 as well as transmits the spring force through the grinding roll 80, which rotates on the grinding surface area 40 and pulverize the fuel which is in form of granule.

Figure 3:
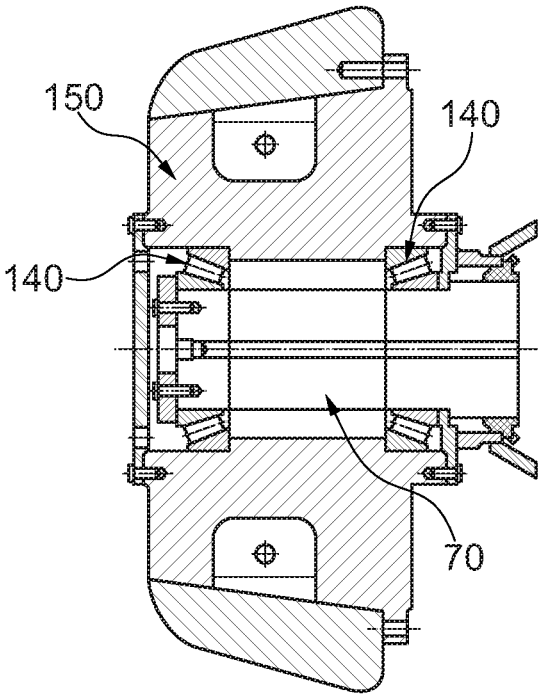
FIG. 3 is a section view of the journal shaft assembly of the pulverizer in accordance with an exemplary embodiment of the present disclosure.

As illustrated in FIG. 3. The journal assembly 50 supports the grinding roll 80 through the journal shaft 70. A single housing 150 accommodate all bearings for example in the present figure two in numbers is shown which single types of bearing 140. The single type of bearing 140 provides support and rigidity to the rotation of the grinding roll 80. One end play for the journal shaft 70 is required as single type of bearings 140 are fitted within the single housing 150. The single housing 150 is made from casting or forging. Due to adjustment of the one end play over the time after prolonged service, this end play will limit the wear & tear. With end play values are within limit for a longer time period, the mill performance will be better with up & even clearance of grinding roll 80 and bull ring segment 190. So, the one end play limits increase the mill performance as well as productivity over a long period of time.

For ease of illustration, only one journal assembly 50 with two single type of bearing 140 and spring assembly 125 are shown and described, but the present disclosure is not limited in this regard, and in other embodiments, the pulverizer 10 may comprise two, three, or more journal assemblies 50 with more number of single type of bearings 140 and spring assemblies 125 with more number of pivot shafts 90, 100, which may be evenly distributed about the grinding surface area 40.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above examples teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure. We claim:

We claim:

1. A pulverizer for pulverizing a fuel, comprising:

a grinding assembly including a grinding table which provides a grinding surface area;

at least one journal assembly including a journal head having a first end connected to a journal shaft that rotatably supports a least one grinding roll, the journal assembly configured to transmit a force through the journal head and the journal shaft to the at least one grinding roll which rotates on the grinding surface area due to rotational force provided by the grinding table, the journal head is pivotally mounted on a pair of pivot shafts to pivot the at least one journal assembly towards the grinding surface area; and at least one spring assembly including a spring in a spring housing, the at least one spring assembly arranged to engage the journal head at a second end of the journal head distal from the first end to provide support and a force via the spring for the pulverization of the fuel to the journal assembly through the journal head.

2. The pulverizer as claimed in claim 1, wherein in the pair of pivot shaft connect the at least one journal assembly to a pulverizer housing.

3. The pulverizer as claimed in claim 1, wherein at least one bearing provides rigidity and support to the rotation of the at least one grinding roll in the at least one journal assembly.

4. The pulverizer as claimed in claim 3, wherein a single housing is provided to accommodate the at least one bearing in the at least one journal assembly.

5. The pulverizer as claimed in claim 4, wherein the single housing is made from casting or forging in the at least one journal assembly.

6. The pulverizer as claimed in claim 3, wherein the at least one journal assembly employs a single end play for the at least one bearing.

7. The pulverizer as claimed in claim 1, wherein the at least one journal assembly is sized for retrofit in the pulverizer.

* * * * *